US005319831A

United States Patent [19]

Takehara

[11] Patent Number: 5,319,831

[45] Date of Patent: Jun. 14, 1994

[54] FIBER CRIMPING APPARATUS

[75] Inventor: Katsuomi Takehara, Mukou, Japan

[73] Assignee: Kabushiki Kaisha Takehara Kikai Kenkyusho, Kyoto, Japan

[21] Appl. No.: 38,543

[22] Filed: Mar. 29, 1993

Related U.S. Application Data

[63] Continuation of Ser. No. 813,014, Dec. 24, 1991, abandoned.

[30] Foreign Application Priority Data

Mar. 30, 1991 [JP] Japan ..... 3-142305

[51] Int. Cl.[5] ..... D02G 1/12

[52] U.S. Cl. ..... 28/263

[58] Field of Search ..... 28/247, 221, 248, 249, 28/250, 251, 255, 256, 263, 264, 265, 269

[56] References Cited

U.S. PATENT DOCUMENTS

| | | | |
|---|---|---|---|
| T925,009 | 8/1974 | Faw et al. | 28/256 |
| 3,696,185 | 10/1972 | Bolliand et al. | 28/265 X |
| 3,798,718 | 3/1974 | Trifunovic | 28/265 X |
| 3,816,887 | 6/1974 | Smith et al. | 28/256 |
| 3,870,241 | 3/1975 | Norwood | 28/264 X |
| 4,019,228 | 4/1977 | Ozawa et al. | 28/221 |
| 4,908,920 | 3/1990 | Takehara | 28/263 |
| 5,025,538 | 6/1991 | Saleh | 28/263 |

FOREIGN PATENT DOCUMENTS

| | | | |
|---|---|---|---|
| 763024 | 7/1971 | Belgium | 28/221 |
| 1-201540 | 8/1989 | Japan . | |
| 963710 | 7/1964 | United Kingdom . | |
| 963873 | 7/1964 | United Kingdom . | |
| 1148366 | 4/1969 | United Kingdom . | |
| 1408253 | 10/1975 | United Kingdom . | |
| 2211863 | 10/1988 | United Kingdom . | |

*Primary Examiner*—Clifford D. Crowder
*Assistant Examiner*—Larry D. Worrell, Jr.
*Attorney, Agent, or Firm*—Wenderoth, Lind & Ponack

[57] ABSTRACT

A fiber crimping apparatus is disclosed which has an internally contacting type nip roller which consists of a ring roller and an inscribed roller rotating together in the same direction at the same speed. The apparatus is provided with a control groove formed on the surfaces of the ring roller and/or the inscribed roller holding the fiber bundle between them and which controls the thickness in the transverse direction of the fiber bundle to be crimped. As the fiber bundle in the nip zone is controlled in the transverse direction, the constriction of the fiber bundle is produced evenly in full width and the crimping process produces even waves and the apparatus is operated stably.

9 Claims, 2 Drawing Sheets

FIBER CRIMPING APPARATUS

This application is a continuation of application Ser. No. 07/813,014, filed Dec. 24, 1991, now abandoned.

BACKGROUND OF THE INVENTION

1. Field of the Invention

This invention relates to a fiber crimping apparatus which is designed to give waves to the synthetic fibers formed straight by fiber drawing devices, and particularly which is provided with a ring roller of a comparatively large diameter and an inscribed roller which contacts the ring roller internally in such a manner that these two rollers rotate in the same direction at the same surface speed, while pressing against each other and which can give waves to the fiber bundles being fed in succession between these two rollers.

2. Description of the Prior Art

Fiber crimping apparatus in which a fiber crimping section is set comparatively long by forming a nip roller for crimping fiber bundles as an inner contact type such that high speed rotation of the nip roller, that is to say, speed-up of the crimping process can be achieved, are disclosed in U.K. Patent No. 1,408,235, U.S. Pat. No. 4,908,920 and Japanese published unexamined patent publication No. Hei.1 (1989)-201,540.

The nip rollers provided in the above-mentioned conventional apparatus are formed such that the surfaces of the outer and inner rollers contact the fiber bundles which are parallel to each other. The fiber bundles fed between these two surfaces are made flat and oblong to some extent by passing a guide at an earlier stage of crimping. But, when the fiber bundles pass the nip roller, both sides of the fiber bundle become thin and, accordingly, pressure on those parts is insufficient compared with that on the relatively thick central part.

Further, the rotating power of the rollers is insufficient compared with that at the central part and causes delays in feeding of the fibers. This results in an uneven crimping, that is to say, a production of irregular waves or a mixture of unwaved fibers or a flying out of fibers from among the delayed fibers on the both sides to outside of the pressing surfaces of the rollers. For that reason, it has become difficult to carry out homogeneous crimping of the fiber bundles without reducing the high-speed processing.

SUMMARY OF THE INVENTION

Therefore, the present invention is intended to provide a fiber crimping apparatus consisting of a ring roller of a comparatively large diameter which rotates in one direction and an inscribed roller which is installed to contact the ring roller internally and which, while holding the fiber bundle between itself and the ring roller, rotates in the same direction at the same speed. The apparatus of the present invention is characterized in that it includes a control means on the surfaces of the ring roller and the inscribed roller operable to hold the fiber bundles between them in order to control the thickness in the transverse direction of the fiber bundle situated in a nip zone.

According to the present invention in which a means to control the thickness in the transverse direction of the fiber bundle situated in a nip zone is formed directly on the surfaces of the ring roller and the inscribed roller which hold the fiber bundle between them, the nip roller itself restrains the fiber bundle and provides sufficient pressure on both sides and avoids irregular waves in the fibers or a mixture of unwaved and waved fibers. Also, the rotating power of the nip roller is conveyed as a feeding power evenly to the full width of the fiber bundle.

BRIEF DESCRIPTION OF THE DRAWINGS

The drawings shows examples of an embodiment of the present invention.

DETAILED DESCRIPTION OF THE PREFERRED EMBODIMENT

Figure 1:
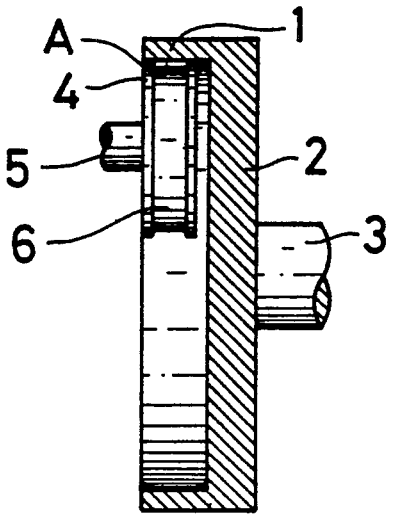
FIG. 1 is a partially cut-away elevation view of working example I of the present invention.

Now, the apparatus made according to the invention is explained below with reference to the preferred embodiment shown in FIGS. 1–4 of the attached drawings.

The working examples of present invention are described below with reference to the accompanying drawings.

In the drawings, 1 is a ring roller of a comparatively large diameter which has a hub 2 on one side and is rotated in one direction by a rotary shaft 3; 4 is an inscribed roller which is installed to contact the ring roller 1 internally and is rotated in the same direction at nearly the same surface speed as the ring roller 1 by a rotary shaft 5 integrally fixed on one side thereof to form a single body; (A) is a control means which is formed on the surfaces of the ring roller 1 and/or the inscribed roller 4 and which controls at a nip zone the thickness in the transverse direction of the fiber bundle to be held between the two rollers.

In the working example I as shown in FIG. 1, the control means (A) of the present invention consists of a circular groove 6 formed on the outer surface of the inscribed roller 4.

Figure 2:
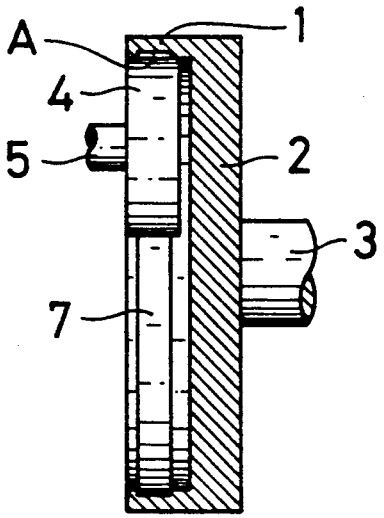
FIG. 2 is a partially cut-away elevation view of working example II.

In the working example II as shown in FIG. 2, the control means (A) consists of a circular groove 7 formed on the inner surface of the ring roller 1.

Figure 3:
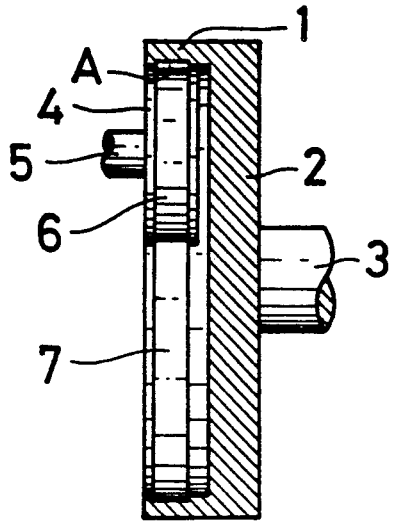
FIG. 3 is a partially cut-away elevation view of working example III.
Figure 4:
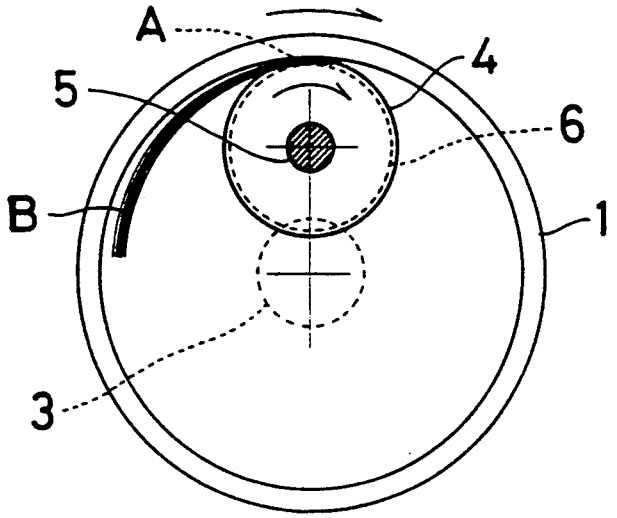
FIG. 4 is an abridged side view to show how an internally contacting type nip roller is formed.

Further, in the working example III as shown in FIG. 3, the control means consists of two grooves, i.e. a circular groove 6 formed on the inscribed roller 4 and a circular groove 7 formed on the ring roller 1 and facing the circular groove 6.

The grooves 6 and 7 are respectively formed so that the control means (A) can have an oblong section. However, when bringing the present invention into practice, the section is not always oblong and may be round or curved nearly like an oval or spindle-shaped or half spindle-shaped.

In the working examples shown in the drawings, the control means (A) consists of a constant groove formed on the surface of the nip roller. However, it may be formed by finishing (or coating) either or both of the inscribed roller 4 and the ring roller 1 with an elastic material like rubber.

The fiber crimping apparatus according to the present invention having the control means (A) which is formed on either or both of the surfaces of the inscribed roller 4 and the ring roller 1 as above-mentioned in order to control the thickness in the transverse direction of the fiber bundle in the nip zone, makes the thickness of the fiber bundle in the nip zone even in the transverse direction or makes the pressing surface change elastically according to a change of thickness in the transverse direction. Thereby, an even constriction and pressure in the transverse direction is also given to the fiber bundle (B) which passes between the inscribed roller 4 and the ring roller 1 and an even feeding speed is produced across the full width. As a result, it is possible to crimp fibers without producing irregular waves or without mixing unwaved fibers with waved fibers. Further, it is possible to eliminate delays in the feeding of fibers which can easily occur on opposing side of the fiber bundle.

As explained above, the fiber crimping apparatus of the present invention having the control means on the internally contacting type nip roller to control the thickness in the transverse direction of the fiber bundle has such excellent effects as it produces even waves and prevents a mixture of unwaved fibers without damaging the high-speed crimping process and guarantees continuation of a regular operation.

I claim:

1. A fiber crimping apparatus comprising:

a ring roller of a first diameter;

an inscribed roller of a second diameter smaller than said first diameter disposed within said ring roller for rotation in a predetermined direction with an exterior periphery of said inscribed roller contacting an interior periphery of said ring roller to define a nip zone to which a bundle of fiber is adapted to be disposed between said exterior periphery of said inscribed roller and said interior periphery of said ring roller;

wherein said exterior periphery of said inscribed roller includes a radially outwardly facing contact surface for contacting the bundle of fibers in said nip zone, and said interior periphery of said ring roller includes a radially inwardly facing contact surface for contacting the bundle of fibers in said nip zone; and wherein a control means is disposed on at least one of said interior periphery of said ring roller and said exterior periphery of said inscribed roller for controlling a width to which the bundle of fibers is flattened between said ring roller and said inscribed roller in said nip zone when the bundle of fibers is disposed between said contact surfaces of said ring roller and said inscribed roller, and for maintaining a predetermined gap between said radially outwardly facing contact surface of said inscribed roller and said radially inwardly facing contact surface of said ring roller, even when the handle of fibers is not disposed therebetween, to control a thickness to which the bundle of fibers is flattened between said ring roller and said inscribed roller at said nip zone when the bundle of fibers is disposed between said contact surfaces of said ring roller and said inscribed roller.

2. A fiber comprising apparatus as recited in claim 1, wherein said control means comprises at least one groove respectively formed in at least one of said exterior periphery of said inscribed roller and said interior periphery of said ring roller.

3. A fiber crimping apparatus as recited in claim 2, wherein said at least one groove comprises only one groove which is formed in said exterior periphery of said inscribed roller.

4. A fiber crimping apparatus as recited in claim 3, wherein said one groove has transversely opposing side walls which contact said interior periphery of said ring roller in said nip zone to define said predetermined gap which determines the thickness to which the bundle of fibers is flattened.

5. A fiber crimping apparatus as recited in claim 2, wherein said at least one groove comprises only one groove which is formed in said interior periphery of said ring roller.

6. A fiber crimping apparatus as recited in claim 5, wherein said one groove has transversely opposing side walls which contact said exterior periphery of said inscribed roller to define said predetermined gap which determines the thickness to which the bundle of fibers is flattened.

7. A fiber crimping apparatus as recited in claim 2, wherein said at least one groove comprises grooves formed in said exterior periphery of said inscribed roller and said interior periphery of said ring roller, respectively.

8. A fiber crimping apparatus as recited in claim 7, wherein each of said grooves has transversely opposing side walls which respectively contact the transversely opposing side walls of the other of said grooves in said nip zone to define a gap which determines the thickness to which the bundle of fibers is flattened.

9. A fiber crimping apparatus as recited in claim 1, wherein said control means comprises an elastic coating on at least one of said exterior periphery of said inscribed roller and said interior periphery of said ring roller.

* * * * *